US006616170B1

(12) United States Patent
Quarti

(10) Patent No.: US 6,616,170 B1
(45) Date of Patent: Sep. 9, 2003

(54) FOLDING SKI

(76) Inventor: Franco Quarti, Ossington Street, London (GB)

( * ) Notice: Subject to any disclaimer, the term of this patent is extended or adjusted under 35 U.S.C. 154(b) by 0 days.

(21) Appl. No.: 09/959,058

(22) PCT Filed: Apr. 14, 2000

(86) PCT No.: PCT/IT00/00149

§ 371 (c)(1),
(2), (4) Date: Dec. 31, 2001

(87) PCT Pub. No.: WO00/62876

PCT Pub. Date: Oct. 26, 2000

(30) Foreign Application Priority Data

Apr. 16, 1999 (IT) ..... BG99A0023

(51) Int. Cl.[7] ..... A63C 5/02
(52) U.S. Cl. ..... 280/603; 280/607; 403/102
(58) Field of Search ..... 280/603, 607; 403/52, 83, 101, 102; 16/319, 352, 353

(56) References Cited

U.S. PATENT DOCUMENTS 2,289,459 A * 7/1942 Rydberg ..... 280/603
2,332,404 A * 10/1943 Smith ..... 280/603
2,678,829 A * 5/1954 Meland ..... 280/603
3,689,093 A * 9/1972 Meland et al. ..... 280/603
4,125,273 A * 11/1978 Rothmayer ..... 280/603
4,358,130 A * 11/1982 Adams ..... 280/603
4,405,150 A 9/1983 Esper
4,530,511 A * 7/1985 Brandt, III ..... 280/603
4,593,926 A * 6/1986 Pergola ..... 280/603
4,632,418 A * 12/1986 Brue Moya et al. ..... 280/603
4,645,228 A * 2/1987 Bertonneau ..... 280/603
4,780,929 A * 11/1988 Burns et al. ..... 16/349

FOREIGN PATENT DOCUMENTS

EP 0 042 449 12/1981

* cited by examiner

*Primary Examiner*—Brian L. Johnson
*Assistant Examiner*—Brian L Swenson
(74) *Attorney, Agent, or Firm*—McGlew and Tuttle, P.C.

(57) ABSTRACT

A folding ski consists in the possibility of folding the ski itself, by means of a mechanical system contained within it and forming part, to all effects, of the construction of the ski. The innovative mechanism makes it possible to reduce the bulk of the equipment and makes it easier to transport. In addition, not only does it maintain the physical, mechanical and dynamic characteristics required for practicing the various sporting disciplines, but it offers better performance and safety qualities than a traditional ski.

16 Claims, 5 Drawing Sheets

FOLDING SKI

FIELD OF THE INVENTION

This invention concerns a folding ski that can be used for all the following ski disciplines: downhill, cross-country, alpine, acrobatic, snowboard and telemark.

STATE OF THE ART

It is well-known that skis of all types used today, whether for alpine skiing, Nordic skiing, telemark, or snowboard, are pieces of equipment which vary in length and width according to the various uses, and which are made in such a way that their bulk can not be varied, given that the body of the equipment is a single unbroken piece. This creates difficulties for transporting the equipment and means using special ski racks fixed to the car roof, given that it is the length in particular that is the limiting factor.

Putting the skis on the roof of a vehicle, as happens with the skis currently in commerce, has been shown in recent studies to be highly dangerous. In the case of an accident (crashes between vehicles or bumps and knocks received during normal driving), the skis can become detached from their support as a result of the impact and their kinetic energy, becoming "spears" hurtling towards another vehicle and its occupants, with the risk of causing serious damage or injury.

The skis produced today differ from one another on the basis of the construction methods used by the various manufacturers; furthermore, even within the same ski type, there a differences due to the specific final use. However, it is possible to organise and classify the essential ski parts that constitute the equipment. It consists of an underside for sliding the metal edges on either side of the underside for cutting into the snow, a core made in wood or injected material, an outer covering made in composite materials and with printed designs. Furthermore, it is common practice nowadays to fix a shock-absorber plate between the ski and the ski boot bindings, which helps improve the elasticity of ski-binding unit as well as increasing the distance between the boots themselves and the underside of the ski.

Aims and Advantages of the Invention

The aim of tis invention is to supply a folding ski, with reduced bulk in terms of length.

In order to overcome the above cited drawbacks of the traditional ski, folding skies have already been proposed. In particular, patents U.S. Pat. No. 3,689,093 and U.S. Pat. No. 4,632,418 disclose folding skies for use in any discipline, divided into a front part and a rear part which are destined to fit together in an inclined plane with respect to their soles when the ski is ready for the use and provided with simple hinging means for folding the two parts of the ski, sole against sole.

These folding skies, however, don't meet the technical-functional features which are nowadays requested to a ski, especially for downhill, such as a grater elasticity combined with the use of raising and shock-absorber plates.

Another aim, deriving from the first, is to make a ski that maintains the physical and mechanical characteristics required to practice the sport of skiing in all its forms, but which can be folded in half in order to make transportation easier, no longer by using special systems, but using any kind of container with reduced dimensions, which, consequently, can be stowed easily in the boot of the vehicle.

DETAILS OF THE INVENTION

These aims are achieved with a ski for use in all skiing disciplines, consisting of:

- a separate front and back part of the ski, each having an underside and edges, with the adjoining ends designed to fit together;
- a hinging device located between said adjoining ends for joining them together rigidly in a position that is both aligned and co-planar with the ski, and which will allow the two parts of the ski to fold over (without becoming completely detached) in an overlapping position, underside against underside; and
- means for stabilising the two parts of the ski in the aligned position.

This invention is applicable to skis both with or without the usual shock-absorbing plate and the support platform for the ski boot bindings.

BRIEF DESCRIPTION OF THE DRAWINGS

Further details of the invention will become clear from the following description, made with reference to the enclosed drawings, which are indicative but not binding, and where.

DETAILED DESCRIPTION OF THE INVENTION

Figure 1:
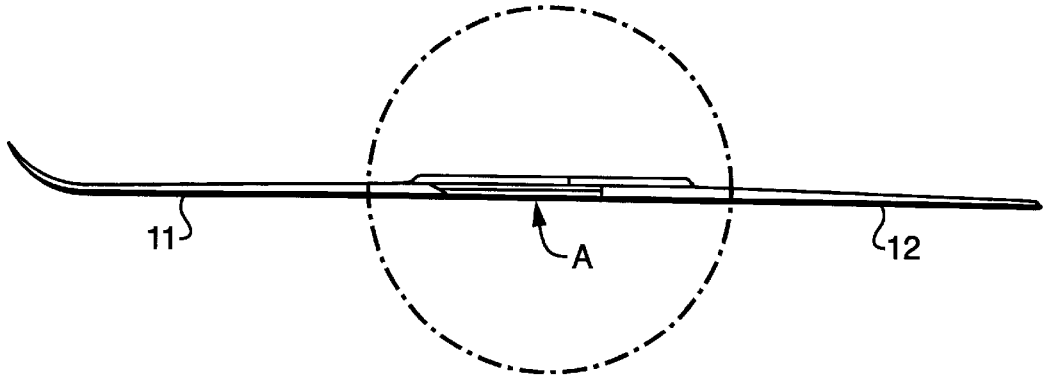
FIG. 1 shows a ski ready for use.

The ski in question consists of two separate parts, a front part 11 and a rear part 12, each consisting of an underside 13 to which the edges 13' are applied, of a core 14 in wood or injected material, of a covering 15 in composite material. In the version in FIGS. 1–7, the adjoining ends of the two parts of the ski 11 and 12 fit together in an inclined plane 12'. These also incorporate an upper base 16 for fastening the bindings and a hinging device A for joining said ends. This device consists of two internal plates 17 and 18 in composite material, for example carbon, kevlar, or fiberglass, joined by means of a hinge axis 19. The first plate 17 is fixed to one part of the ski, in the example shown it is the rear part 12, while the other plate 18 can slide along a runner 20 located on the other part of the ski, the front part 11.

Figure 2:
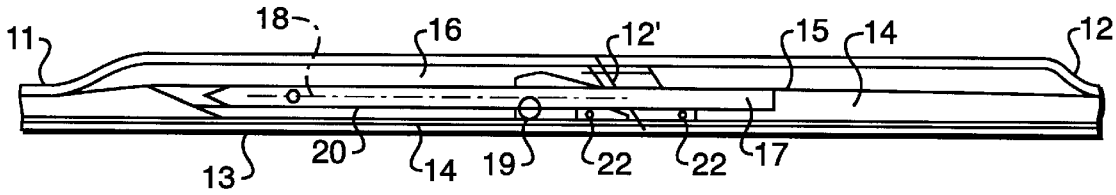
FIG. 2 shows an enlarged view of part of the ski circled in FIG. 1, in a first version.
Figure 2A:
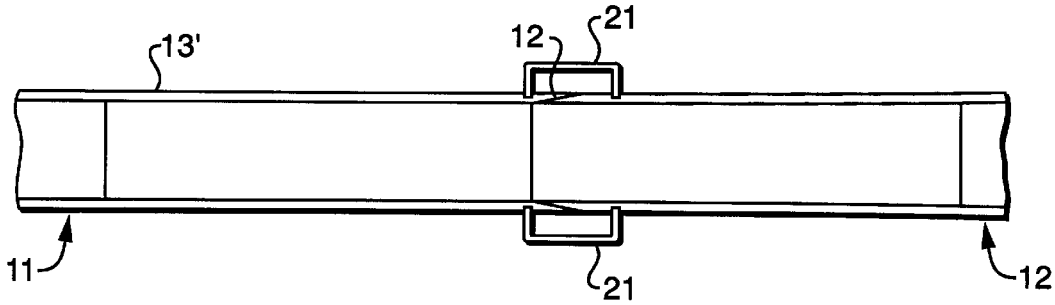
FIG. 2*a* shows a view from above of FIG. 2, with a first stabilising system.
Figure 3:
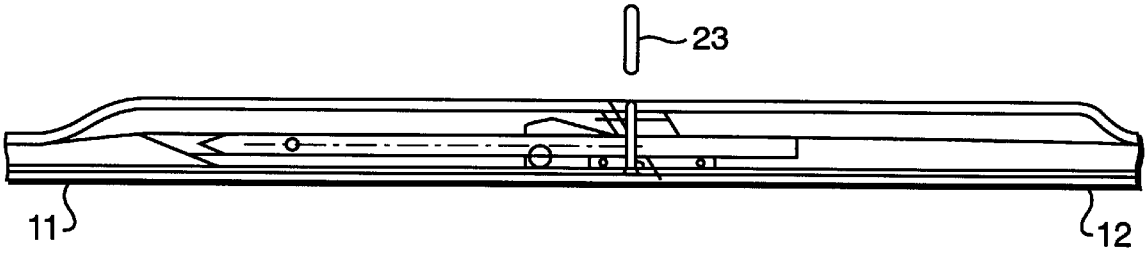
FIG. 3 shows an enlarged view of the part of the ski circled in FIG. 1, but with another stabilising system.
Figure 3A:
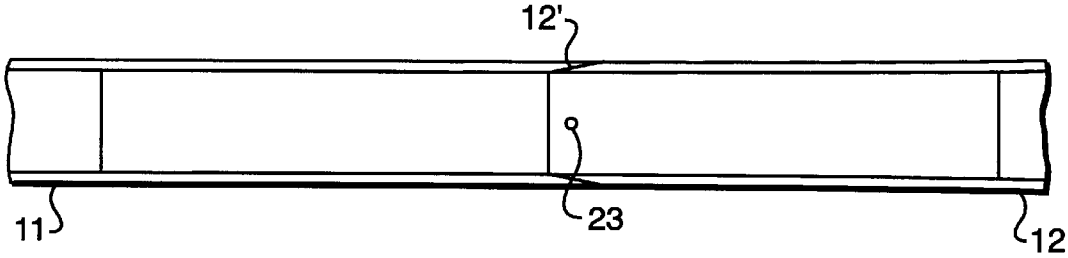
Figure 4:
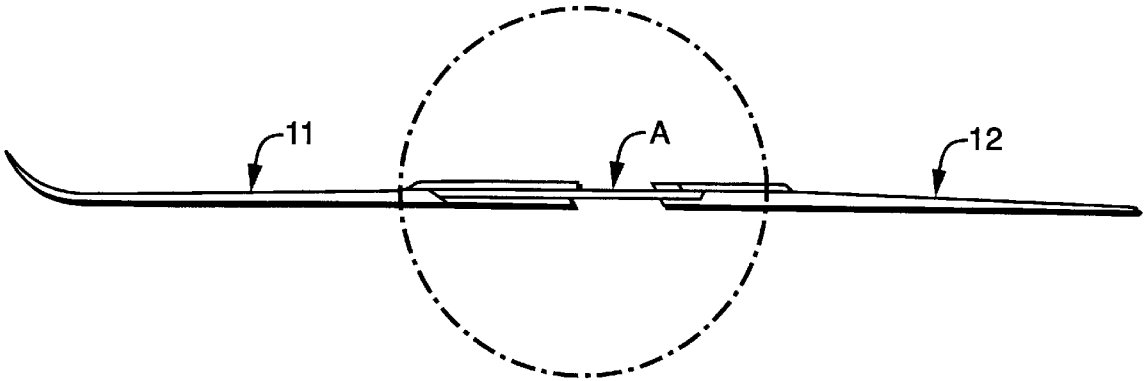
FIG. 4 shows a view of the two parts of the ski at the moment of separation before folding over.

When the ski is ready for use, the sliding plate 18 and at least one part of the fixed plate 17, near to the hinge axis 19, are inserted into the runner 20 and the two parts 11 and 12 of the ski are kept aligned and co-planar. This position is ensured by means of two check pins 21, to be inserted into two corresponding holes 22 located on opposite sides of the matching plane 12' (FIGS. 2, 2*a*). As an alternative, it is possible to use a vertical pin 23 for this purpose, placing it perpendicularly to one of the hinging plates 17, 18, as shown in FIGS. 3 and 3*a*, and which can also be designed so as to cause, once removed, a slight separation of the two ski parts 11, 12 in such a way as to facilitate the successive phase of folding.

Figure 5:
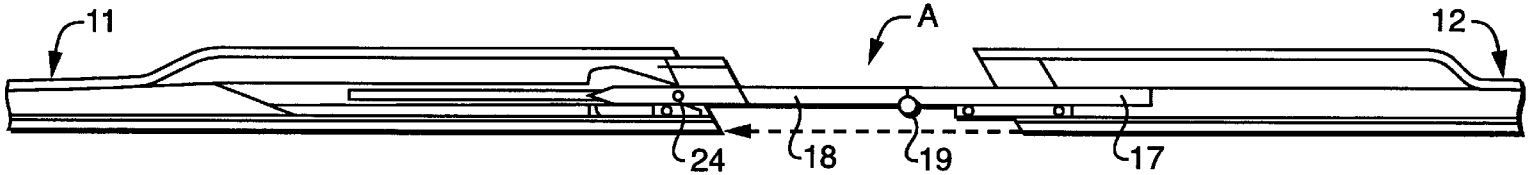
FIG. 5 shows an enlarged view of the part of the ski circled in FIG. 4.
Figure 5A:
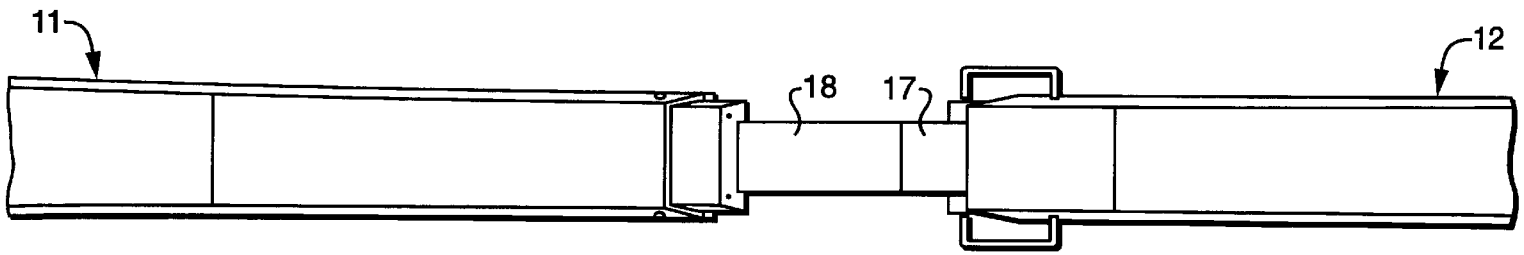
FIG. 5*a* shows a view from above of FIG. 5.

To fold the ski, having removed the check pin or pins, it is necessary first to separate the two front and rear parts by extracting the plate 18 from its runner 20. Said plate 18 is prevented from coming out from the runner completely by a catch 24, located near the front end and interacting with a stop placed at the mouth of the runner 20 (FIGS. 5, 5*a*).

Figure 6:
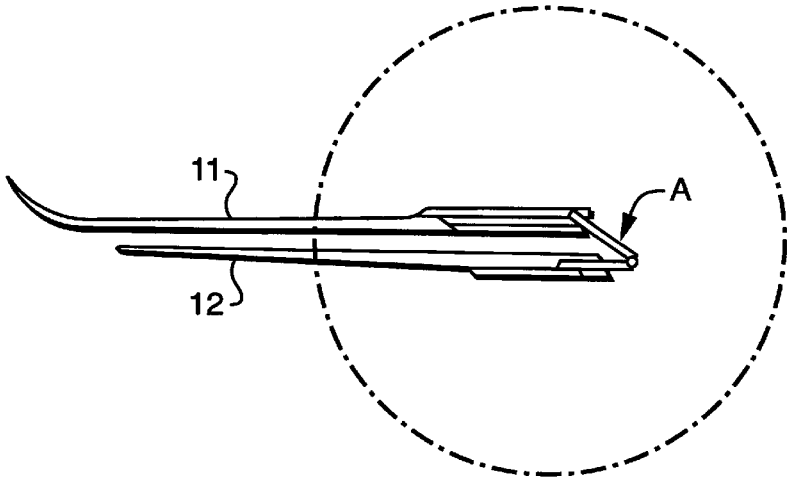
FIG. 6 shows a view of the ski when folded over.
Figure 7:
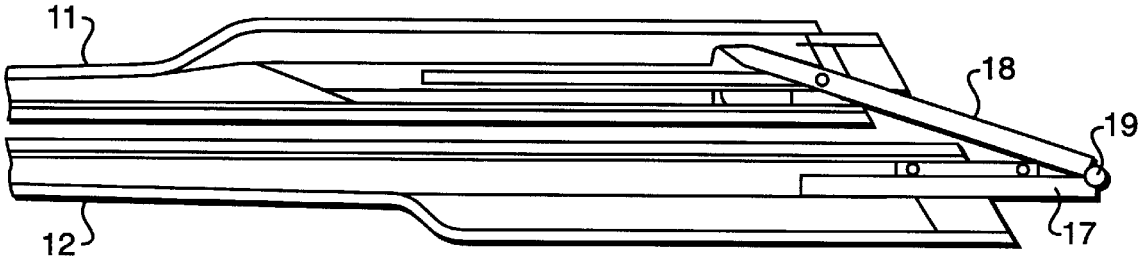
FIG. 7 shows an enlarged view of the part of the ski circled in FIG. 6.

Once the two parts 11 and 12 have been separated, they are in a position to rotate with respect to one another around the hinge axis 19 that joins the two plates 17, 18, until they come together in parallel, with their undersides 13 facing (FIGS. 6, 7).

Figure 8:
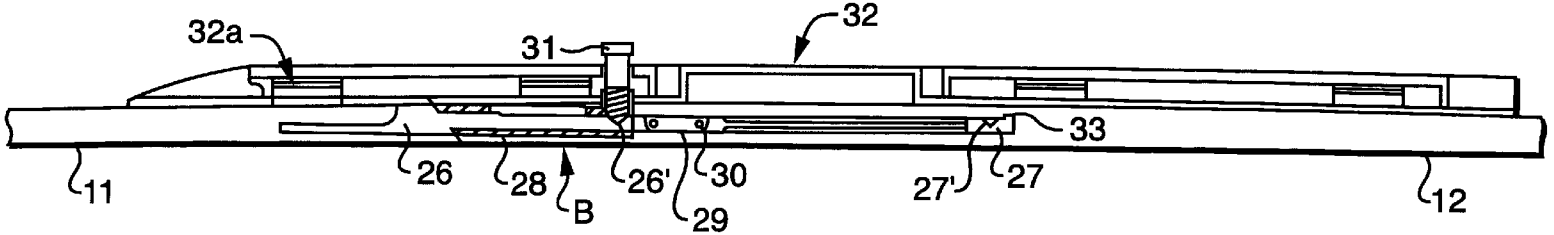
FIGS. 8, 9 and 10 show views of one ski ready for use, at the moment of separating its two parts for folding over, and folded over, respectively, with the hinging device in a second version.
Figure 9:
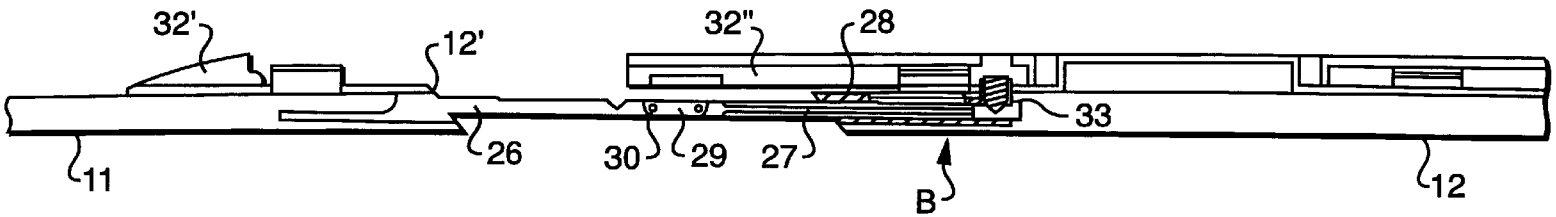
Figure 10:
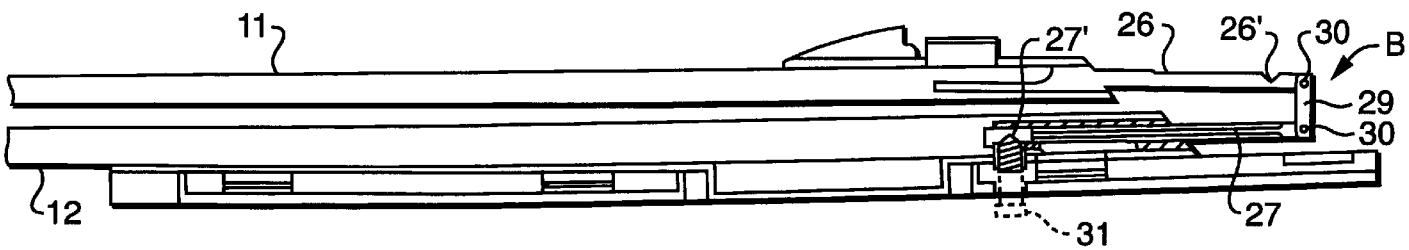

In the version shown in FIGS. 8, 9 and 10, the adjacent ends of the two parts of the ski 11 and 12 still join in an inclined plane 12'. However, they incorporate a hinging device B, consisting of three elements: a first plate 26 fixed to the adjoining end of one of the ski parts, for example the front one, a second sliding plate 27 which fits the adjoining end of the other part of the ski, being joined with a runner 28, and a third hinging plate 29, joining the first two by means of hinge axes 30, set at right angles to the ski. The plates 26 and 27 have housings 26' and 27' designed to take a fixing screw 31. This screw is perpendicular to the plates 26, 27 and, when tightened in the housing 26', it stabilises the two parts of the ski ready for use (FIG. 8) and, when tightened in the housing 27', it stabilises the two parts of the folded ski (FIG. 10).

The sliding plate 27 also has a blocking ridge 33 designed to interact with one end of the runner 28 in order to prevent the two parts of the ski from becoming completely detached when they are separated (FIG. 9).

For this reason, in this case too, when the ski is ready for use (FIG. 8), the front and rear parts are brought together and held in that position by the screw 31, which is tightened in the housing 26' of the fixed plate 26. For folding over, the screw 31 is removed and the two parts of the ski separated (FIG. 9), folding them by rotation around the hinging axes 30, until they are brought together and blocked again with the screw 31, as shown in FIG. 10.

It should be noted that the screw 31 can also be used for blocking in the version shown in FIGS. 1–7, in place of the pin 23 perpendicular to the hinging plate.

It is worth mentioning, furthermore, that both versions of the ski can be equipped with a usual base plate as support platform for the bindings 32, with the sole requirement that said base plate be divided into two parts 32' and 32", each fixed to a respective part of the ski and both designed to fit together in a drawer-like fashion 32*a* when the two ski parts are aligned and blocked ready for use.

What is claimed is:

1. A ski comprising:

a front part with an underside and edges;

a rear part with an underside and edges, said front part and said rear part being divided and said front part and said rear part having adjoining ends to be joined together;

a hinging device disposed between said adjoining ends of said front part and said rear part to join said front part and said rear part rigidly in an aligned and co-planar position for use of the ski and to allow a folding over of said front part and said rear part, without complete separation of said front part and said rear part, in an overlapping position of said underside of said front part against said underside of said rear part, said adjoining ends of said two ski parts fit together in an inclined plane with respect to said underside of said front part against said underside of said rear part, said hinging device having a first hinging plate fixed to an adjoining end of one of said front part and rear parts, and a second hinging plate which slides to fit with an adjoining end of the other of said front part and rear parts, and a hinge axis joining the two adjoining ends of said first hinge plate and said second hinge plate and set at right angles to a ski direction;

means for stabilizing said front part and said rear part in said aligned position;

a raising plate arranged in a ski binding area.

2. A ski according to claim 1, wherein said second plate slides along a runner placed longitudinally in a respective one of said front part and rear part ski part and starting from an adjoining end of the latter, said runner being deep enough to receive the two plates when the two ski parts are in an aligned position.

3. A ski according to claim 1, wherein said hinging device has a third hinging plate which joins said first and second hinging plate, said third plate being united to said first and second hinging plate with hinging axes set at right angles to a ski direction.

4. A ski according to claim 3, wherein said second plate is joined by and slides along a runner placed longitudinally in a respective one of said front part and rear part, starting from the adjoining end of the latter, said runner being deep enough to receive the three hinging plates when said front part and rear part are in the aligned position.

5. A ski according to claim 2, wherein a longitudinal housing for the sliding of the second hinging plate is defined by a channel-like element incorporated into the respective ski part, and wherein said second hinging plate has a means for blocking the extraction, designed to intercept a blocking ridge along the runner in order to prevent the two parts of the ski from becoming completely detached.

6. A ski according to claim 1, wherein two check pins are placed in holes located transversely in said front part and rear part and stabilize said front part and rear part in the aligned position, said two pins being on opposite sides of the matching plane.

7. A ski according to claim 1, wherein at least one blocking means, placed perpendicularly to one hinging plate and acting upon it, stabilizes said front part and rear part at least in the aligned position, said blocking means consisting of a pin or a screw and being designed to allow the two ski parts to separate once said blocking means is removed.

8. A ski according to claim 1, wherein said raising plate is formed as a platform plate for supporting ski bindings, wherein said platform plate is divided into two portions, a first portion on one of said front and rear part, and a second portion on another of said front and rear part, said two portions joining together in drawer-like fashion when the two ski parts are in the aligned position and separating when the two ski parts are folded over.

9. A ski comprising:

a first ski part with a joint end;

a first hinge plate fixed to said joint end of said first ski end;

a second hinge plate pivotally connected to said first hinge plate about a hinge axis and pivotal between a first and second positions with respect to said first hinge plate, a second ski part with a joint end defining a chamber receivable of said second hinge plate, said second hinge plate being axially slidable in said chamber when said hinge plates are in said first position to bring said joint ends of said ski parts together and axially align said ski parts;

a lock arrangement connectable to said first and second ski parts for locking said ski parts together when said hinge plates are in said first position, when said joint ends of said ski parts are together and when said ski parts are axially aligned.

10. A ski in accordance with claim 9, wherein:

said second hinge plate is axially slidable outward of said chamber to pivot said hinge plates into said second position and arrange said ski parts folded back against each other.

11. A ski in accordance with claim 10, wherein:

said first hinge plate extends out from said joint end of said first ski part;

said chamber in said second'ski part is receivable of said first hinge plate when said hinge plates are in said first position.

12. A ski in accordance with claim 9, wherein:

said second hinge plate is pivotally connected to said second ski part.

13. A ski in accordance with claim 9, wherein:

said second hinge plate is directly connected to said first hinge plate.

14. A ski in accordance with claim 9, wherein:

said second hinge plate is pivotally connected to said first hinge plate through a third hinge plate;

said chamber in said second ski part is axially receivable of said second and third hinge plates.

15. A ski in accordance with claim 11, wherein:

said second hinge plate is pivotally connected to said first hinge plate through a third hinge plate;

said chamber in said second ski part is receivable of said second and third hinge plates.

16. A ski in accordance with claim 9, wherein:

said first and second hinge plates are arranged in a plane substantially parallel to a plane of said first and second ski parts.

* * * * *